US010649384B2

(12) United States Patent
Hayashi et al.

(10) Patent No.: US 10,649,384 B2
(45) Date of Patent: May 12, 2020

(54) IMAGE FORMING APPARATUS

(71) Applicant: CANON KABUSHIKI KAISHA, Tokyo (JP)

(72) Inventors: Kodai Hayashi, Suntou-gun (JP); Taku Watanabe, Susono (JP); Shuhei Kawasaki, Susono (JP); Keisuke Endoh, Fuji (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/253,552

(22) Filed: Jan. 22, 2019

(65) Prior Publication Data

US 2019/0227476 A1 Jul. 25, 2019

(30) Foreign Application Priority Data

Jan. 24, 2018 (JP) ..... 2018-010094

(51) Int. Cl.
*G03G 15/00* (2006.01)
*G03G 21/00* (2006.01)
(Continued)

(52) U.S. Cl.
CPC ..... *G03G 15/556* (2013.01); *G03G 15/0863* (2013.01); *G03G 15/0877* (2013.01); *G03G 15/55* (2013.01); *G03G 21/0011* (2013.01); *G03G 21/0094* (2013.01); *G03G 21/1889* (2013.01); *G03G 2215/0888* (2013.01)

(58) Field of Classification Search
None
See application file for complete search history.

(56) References Cited

U.S. PATENT DOCUMENTS 6,754,454 B1 * 6/2004 Hiroshima ..... G03G 21/1889 399/12
6,771,924 B2 8/2004 Matsuguma
(Continued)

FOREIGN PATENT DOCUMENTS

EP 3106924 A1 12/2016
EP 3367178 A1 8/2018
(Continued)

OTHER PUBLICATIONS

Extended European Search Report issued in European Appln. No. 19153179.7 dated Jun. 24, 2019.

*Primary Examiner* — Sevan A Aydin
(74) *Attorney, Agent, or Firm* — Rossi, Kimms & McDowell LLP

(57) ABSTRACT

An image bearing member unit and a developing unit are respectively configured to be attachable to and detachable from an apparatus main body of an image forming apparatus, the image bearing member unit has a first memory that stores information related to a toner amount during a toner supply in accordance with a use amount of the image bearing member unit, the developing unit has a second memory that stores information related to a toner amount during the toner supply in accordance with a use amount of the developing unit, and a control device controls, during the toner supply, the toner supply with a toner amount based on the information stored in the first memory and the information stored in the second memory.

18 Claims, 9 Drawing Sheets

(51) Int. Cl.
*G03G 21/18* (2006.01)
*G03G 15/08* (2006.01)

(56) References Cited

U.S. PATENT DOCUMENTS

| | | | | |
|---|---|---|---|---|
| 10,248,062 | B1 * | 4/2019 | Able | G03G 15/5041 |
| 2011/0052220 | A1 | 3/2011 | Nose | |
| 2011/0150512 | A1 | 6/2011 | Tamagaki | |
| 2016/0370752 | A1 * | 12/2016 | Momotani | G03G 15/1605 |
| 2017/0139352 | A1 * | 5/2017 | Sawada | G03G 15/161 |
| 2018/0239274 | A1 * | 8/2018 | Motohashi | G03G 15/0844 |
| 2018/0341192 | A1 * | 11/2018 | Kanazawa | G03G 15/0266 |

FOREIGN PATENT DOCUMENTS

| | | | |
|---|---|---|---|
| JP | H10161426 | A | 6/1998 |
| JP | 2005106920 | A | 4/2005 |

* cited by examiner

FIG.5A

FIRST CALCULATION TABLE TX (EJECTION INFORMATION X)

| | | DRUM CARTRIDGE USE AMOUNT | | | |
|---|---|---|---|---|---|
| | | 0%～24% | 25%～49% | 50%～74% | 75%～100% |
| MAIN BODY USE ENVIRONMENT | ～15℃ | 6 | 0 | 0 | 2 |
| | 15℃～25℃ | 6 | 0 | 0 | 2 |
| | 25℃～ | 6 | 2 | 2 | 4 |

FIG.5B

SECOND CALCULATION TABLE TY (TONER EJECTION AMOUNT Y)

| | | DEVELOPER CARTRIDGE USE AMOUNT | | | |
|---|---|---|---|---|---|
| | | 0%～24% | 25%～49% | 50%～74% | 75%～100% |
| MAIN BODY USE ENVIRONMENT | ～15℃ | 2 | 6 | 6 | 10 |
| | 15℃～25℃ | 2 | 4 | 4 | 6 |
| | 25℃～ | 2 | 4 | 4 | 6 |

FIG.5C

FIRST CALCULATION TABLE TX (TONER EJECTION AMOUNT X)

| | | DRUM CARTRIDGE USE AMOUNT | | | |
|---|---|---|---|---|---|
| | | 0%～24% | 25%～49% | 50%～74% | 75%～100% |
| MAIN BODY USE ENVIRONMENT | ～15℃ | 6 | -30 | -30 | -30 |
| | 15℃～25℃ | 6 | -30 | -30 | -30 |
| | 25℃～ | 6 | -30 | -30 | -30 |

FIG.5D

FIRST CALCULATION TABLE TX (EJECTION INFORMATION X)

| | | DRUM CARTRIDGE USE AMOUNT | | | |
|---|---|---|---|---|---|
| | | 0%～24% | | | |
| DEVELOPER CARTRIDGE USE AMOUNT | | 0%～24% | 25%～49% | 50%～74% | 75%～100% |
| MAIN BODY USE ENVIRONMENT | ～15℃ | ×4 | ×2 | ×2 | ×1.6 |
| | 15℃～25℃ | ×4 | ×2.5 | ×2.5 | ×2 |
| | 25℃～ | ×4 | ×2.5 | ×2.5 | ×2 |

FIG.5E

FIRST CALCULATION TABLE TX (EJECTION INFORMATION X)

| | | DRUM CARTRIDGE USE AMOUNT | | | |
|---|---|---|---|---|---|
| | | 0%～24% | 25%～49% | 50%～74% | 75%～100% |
| MAIN BODY USE ENVIRONMENT | ～15℃ | ×3 | ×0 | ×0 | ×1 |
| | 15℃～25℃ | ×3 | ×0 | ×0 | ×1 |
| | 25℃～ | ×3 | ×1 | ×1 | ×2 |

IMAGE FORMING APPARATUS

BACKGROUND OF THE INVENTION

Field of the Invention

The present invention relates to an image forming apparatus such as a copier, a laser printer, or a facsimile and to a technique for controlling an amount of toner to be supplied as a lubricant to a contact member equipped with a cleaning function.

Description of the Related Art

In an image forming apparatus such as a printer using an electrophotographic image formation system (an electrophotographic process), as means for removing toner remaining after a toner image formed on an image bearing member is transferred to a recording material, means for removing the toner by bringing a cleaning member into contact with a surface of the image bearing member is known. As the cleaning member, a configuration made up of an elastic body constituted by urethane rubber or the like and a supporting metal sheet that supports the elastic body is widely adopted.

In this configuration, an increase in friction force between the cleaning member and the image bearing member may destabilize a behavior of the cleaning member and may cause tuck-up of the cleaning member or abnormal noise due to vibration.

As a solution to this problem, for example, JP 10-161426 (Patent Literature 1) discloses supplying toner to a surface of a photosensitive member (an image bearing member) from a developing unit for the purpose of supplying a lubricant after image formation. Accordingly, a friction force between a cleaning member and a surface of the photosensitive member is reduced, generation of abnormal noise is suppressed, and favorable cleaning performance is maintained.

In addition, JP 2005-106920 (Patent Literature 2) discloses a technique for changing an amount of toner to be supplied to a surface of a photosensitive member from a developing unit in accordance with a use environment of an image forming apparatus, a total number of pixels written during creating a print of a prescribed section, and the like.

However, while the methods described in Patent Literature 1 and 2 are effective for avoiding the problem described above, the methods have the following problem.

For example, a toner supply amount that enables favorable cleaning performance to be maintained is dependent on a cohesion degree of toner, an amount of external additives, and the like. The cohesion degree of toner and the amount of external additives vary depending on not only a use environment or a use state of a developing unit but also on a type of the toner.

A toner amount that enables favorable cleaning performance to be maintained is also dependent on a friction force between a cleaning blade (a contact member) and a photosensitive drum as well as an amount of convolution of a tip of the cleaning blade which is contingent upon the friction force. The amount of convolution of the tip of the cleaning blade varies depending on a use environment or a use state of the cleaning blade and a type of the cleaning blade itself. There are many situations where a type of toner or types of a cleaning blade and other members are changed after start of sales of a process cartridge for the purpose of improving performance, complying with regulations, or the like, in which case it is preferable to accommodate such various configurations.

One way to accommodate such various configurations is to set, in advance, a large toner amount to be fed to a cleaning member. However, in this case, there is a problem in that the toner amount to be fed to the cleaning member may increase needlessly and, accordingly, reduce the number of prints that can be printed by a user, or a different problem such as faulty cleaning may arise.

SUMMARY OF THE INVENTION

The present invention provides an image forming apparatus, including:

an image bearing member unit constituted by a rotatable image bearing member on which an electrostatic latent image is formed and a contact member configured to come into contact with a surface of the image bearing member in a rotating state to remove toner from the surface of the image bearing member;

a developing unit configured to supply toner to the surface of the image bearing member to develop the electrostatic latent image as a toner image; and a control device configured to, during a period where image formation is not performed, supply toner to the surface of the image bearing member from the developing unit to perform toner supply between the contact member and the surface of the image bearing member, wherein the image bearing member unit and the developing unit are respectively configured to be independently attachable to and detachable from an apparatus main body of the image forming apparatus, wherein the image bearing member unit has a first memory that stores information related to a toner amount during the toner supply in accordance with a drive amount of the image bearing member, wherein the developing unit has a second memory that stores information related to a toner amount during the toner supply in accordance with a use amount of the developing unit, and wherein the control device controls, during the toner supply, the toner supply with a toner amount based on the information stored in the first memory and the information stored in the second memory.

Further features of the present invention will become apparent from the following description of exemplary embodiments (with reference to the attached drawings).

BRIEF DESCRIPTION OF THE DRAWINGS

FIGS. 5A to 5E are calculation table of an ejected toner amount according to a first embodiment;

DESCRIPTION OF THE EMBODIMENTS

Embodiments of the present invention will now be exemplarily described in detail with reference to the drawings.

However, it is to be understood that dimensions, materials, shapes, relative arrangements, and the like of components described in the embodiments are intended to be changed as deemed appropriate in accordance with configurations and various conditions of apparatuses to which the invention is to be applied and are not intended to limit the scope of the invention to the embodiments described below.

Image Forming Apparatus

Figure 1:
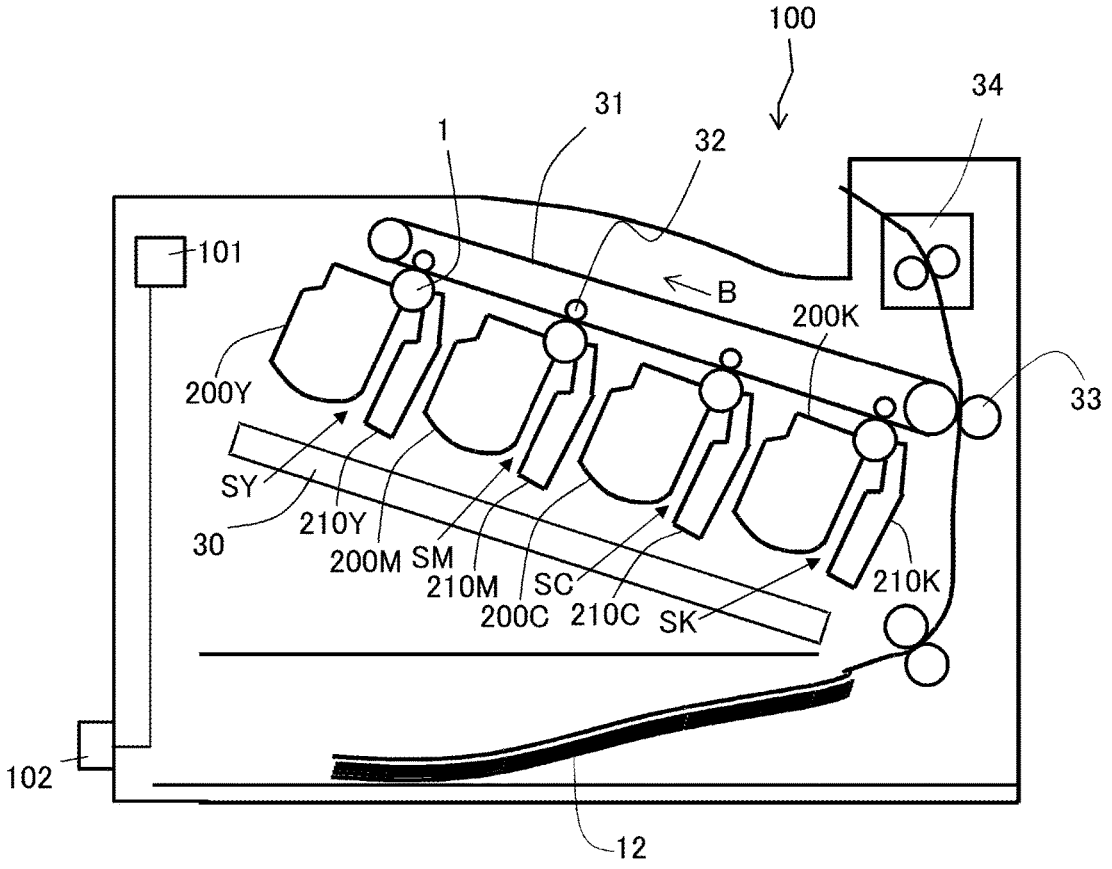
FIG. 1 is a schematic view of an image forming apparatus.

First, an overall configuration of an image forming apparatus to which the present invention is applied will be described with reference to FIG. 1.

An image forming apparatus 100 according to the present invention is a full-color laser beam printer adopting an in-line system and an intermediate transfer system and is capable of forming a full-color image on a recording material (for example, recording paper, a plastic sheet, or cloth) in accordance with image information.

The image information is input to an image forming apparatus main body from an image reading apparatus connected to the image forming apparatus main body or from a host device such as a personal computer connected to the image forming apparatus main body so as to be capable of communication. The image forming apparatus 100 has SY, SM, SC, and SK as a plurality of image forming portions for forming images of the respective colors of yellow (Y), magenta (M), cyan (C), and black (K). In the present embodiment, the image forming portions SY, SM, SC, and SK are arranged in a single row in a direction intersecting a vertical direction.

The image forming portions SY, SM, SC, and SK are constituted by drum cartridges 210 (210Y, 210M, 210C, and 210K) as image bearing member units and developing cartridges 200 (200Y, 200M, 200C, and 200K) as developing units. The drum cartridges 210 and the developing cartridges 200 are configured to be attachable to and detachable from the image forming apparatus 100 via mounting means such as a mounting guide, a positioning member, or the like provided on the image forming apparatus main body. In the present embodiment, all of the drum cartridges 210 and the developing cartridges 200 for the respective colors have a same shape, and toners of the respective colors of yellow (Y), magenta (M), cyan (C), and black (K) are stored in the developing cartridges 200 for the respective colors. While a configuration in which the drum cartridge 210 and the developing cartridge 200 are independently attachable and detachable will be described in the present invention, alternatively, a configuration may be adopted in which the drum cartridge 210 and the developing cartridge 200 are integrated and are attachable to and detachable to the image forming apparatus main body as a single unit.

A photosensitive drum 1 is rotationally driven by driving means (a drive source). A scanner unit (an exposing apparatus) 30 is arranged around the photosensitive drum 1. The scanner unit 30 is exposing means which irradiates a laser beam based on image information and forms an electrostatic image (an electrostatic latent image) on the photosensitive drum 1. Writing of laser exposure is performed in a main scanning direction (a direction perpendicular to a transport direction of a recording material 12) from a position signal inside a polygon scanner referred to as a BD for each scanning line. On the other hand, in a sub-scanning direction (the transport direction of the recording material 12), writing of laser exposure is performed after a delay of a prescribed time from a TOP signal originating from a switch (not illustrated) inside a transport path of the recording material 12. Accordingly, in the fourth image forming portions SY, SM, SC, and SK, laser exposure can always be performed with respect to a same position on the photosensitive drum 1.

An intermediate transfer belt 31 as an intermediate transfer member for transferring a toner image on the photosensitive drum 1 to the recording material 12 is arranged so as to oppose the four photosensitive drums 1.

The intermediate transfer belt 31 as an intermediate transfer member formed by an endless belt is in contact with all of the photosensitive drums 1 and circulatively moves (rotates) in a direction of an illustrated arrow B (counterclockwise). Four primary transfer rollers 32 as primary transfer means are arranged parallel to each other on a side of an inner peripheral surface of the intermediate transfer belt 31 so as to oppose each photosensitive drum 1. Furthermore, a bias having an opposite polarity to a normal charging polarity of the toners is applied to the primary transfer roller 32 from a primary transfer bias power supply (a high-voltage power supply) as primary transfer bias applying means (not illustrated). Accordingly, a toner image on the photosensitive drum 1 is transferred (primarily transferred) onto the intermediate transfer belt 31.

In addition, a secondary transfer roller 33 as secondary transfer means is arranged on a side of an outer peripheral surface of the intermediate transfer belt 31. Furthermore, a bias having an opposite polarity to the normal charging polarity of the toilers is applied to the secondary transfer roller 33 from a secondary transfer bias power supply (a high-voltage power supply) as secondary transfer bias applying means (not illustrated). Accordingly, a toner image on the intermediate transfer belt 31 is transferred (secondarily transferred) onto the recording material 12. For example, when forming a full-color image, the process described above is sequentially performed by the image forming portions SY, SM, SC, and SK, and toner images of the respectively colors are primarily transferred onto the intermediate transfer belt 31 by being sequentially superimposed on one another. Subsequently, the recording material 12 is transported to a secondary transfer portion in synchronization with a movement of the intermediate transfer belt 31. In addition, due to an action of the secondary transfer roller 33 in contact with the intermediate transfer belt 31 via the recording material 12, the four-color toner images on the intermediate transfer belt 31 are collectively secondarily transferred onto the recording material 12.

The recording material 12 onto which the toner images have been transferred is transported to a fixing apparatus 34 as fixing means. Heat and pressure are applied to the recording material 12 by the fixing apparatus 34 to fix the toner images onto the recording material 12.

DRUM Cartridge

Next, a configuration of the drum cartridge 210 will be described.

Figure 2:
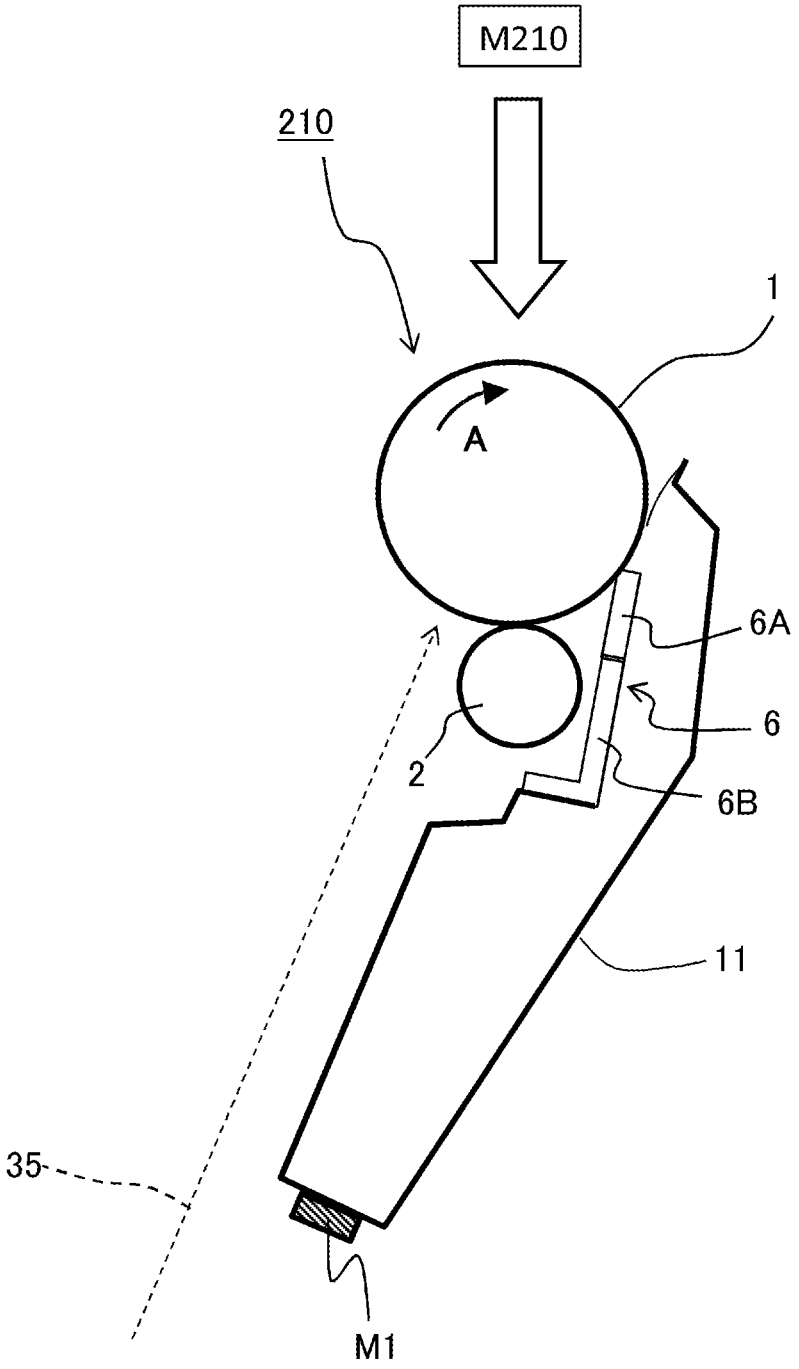
FIG. 2 is a schematic view of a drum cartridge illustrated in FIG. 1.

FIG. 2 is a sectional (a main sectional) view of the drum cartridge 210 according to the present invention as viewed along a longitudinal direction (a rotational axis direction) of the photosensitive drum 1.

The photosensitive drum 1 is rotatably attached to the drum cartridge 210 via a bearing (not illustrated). The photosensitive drum 1 is rotationally driven in a direction of an illustrated arrow A in accordance with an image forming operation by receiving a driving force of a drive motor M210 as driving means.

In addition, a charging roller 2 and a cleaning blade 6 as a contact member formed by an elastic body are arranged in the drum cartridge 210 so as to come into contact with a surface of the photosensitive drum 1 in a rotating state. A bias sufficient for causing an arbitrary charge to be carried on the photosensitive drum 1 is applied to the charging roller 2 from a charging bias power supply (a high-voltage power supply) as charging bias applying means (not illustrated). In the present embodiment, the applied bias is set so that a potential (a charging potential: Vd) on the photosensitive drum 1 is −500 V. A laser beam 35 is irradiated from the scanner unit 30 based on image information and forms an electrostatic image (an electrostatic latent image) on the photosensitive drum 1.

The cleaning blade 6 is integrally formed by a rubber blade 6A and a cleaning supporting metal sheet 6B that supports the rubber blade 6A. For the rubber blade 6A, for example, urethane rubber with a thickness of 2 mm and an MD-1 hardness of 60 to 80° in a 23° C.-environment is used. The cleaning blade 6 is fixed to a drum cartridge frame body 11 and arranged so that a tip of the rubber blade 6A comes into contact with the photosensitive drum 1. Using a tip of a free end of the rubber blade 6A, the cleaning blade 6 scrapes off toner which has not been transferred to the intermediate transfer belt 31 and which remains on the surface of the photosensitive drum 1. The toner scraped off by the cleaning blade 6 (hereinafter, waste toner) is stored inside the drum cartridge frame body 11. A part of the waste toner accumulates on the tip of the free end of the rubber blade 6A, and imparts lubricity between the photosensitive drum 1 and the rubber blade 6A and stabilizes cleaning performance.

In addition, the drum cartridge 210 is provided with a nonvolatile memory (hereinafter, referred to as an "O memory") M1 as a first memory. The O memory M1 stores information related to operation amounts such as the number of revolutions of the photosensitive drum 1. The O memory M1 also stores information that enables a type of the drum cartridge 210 to be specified such as a serial number and a model. In addition, based on the information in the O memory M1, a control portion 101 is capable of assessing amounts related to use of the drum cartridge in terms of how much the drum cartridge has been used and how long the drum cartridge has been operational. The O memory M1 is configured so as to be capable of communicating (writing and reading information) with the control portion 101 of the image forming apparatus 100 illustrated in FIG. 1 in a contactless manner or by contact via an electrical contact.

Developing Cartridge

Figure 3:
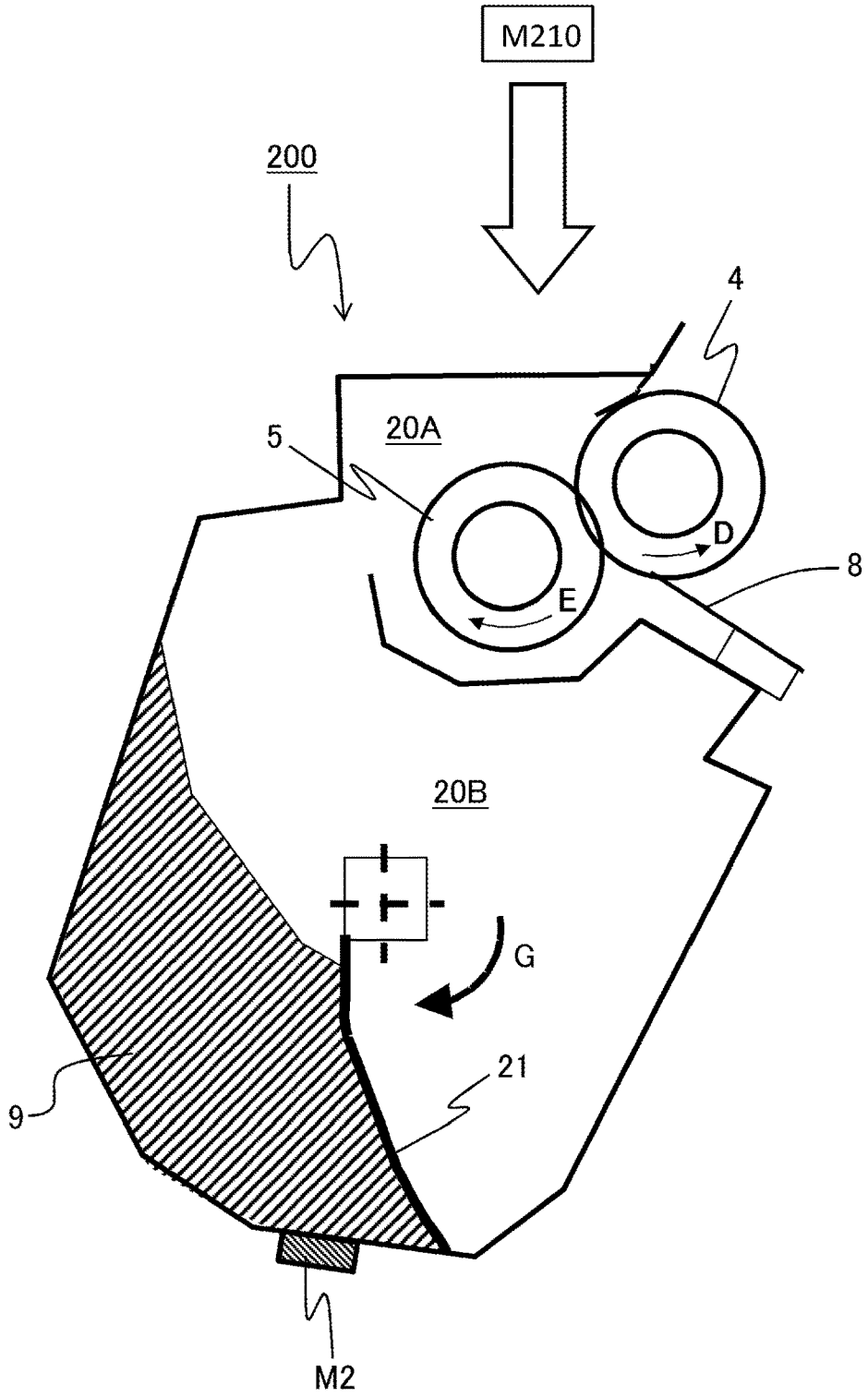
FIG. 3 is a schematic view of a developing cartridge illustrated in FIG. 1.

Next, a configuration of the developing cartridge 200 that is mounted to the image forming apparatus according to the present invention will be described. FIG. 3 is a sectional (a main sectional) view of the developing cartridge 200 according to the present invention as viewed along a longitudinal direction (a rotational axis direction) of a developing roller 4.

The developing cartridge 200 is constituted by a developing chamber 20A and a developer storage chamber 20B, and the developer storage chamber 20B is arranged below the developing chamber 20A. Toner 9 as a developer is stored inside the developer storage chamber 20B. In the present invention, a normal charging polarity of the toner 9 uses negative polarity and, hereinafter, a case where a negative-charging toner is used will be described. However, the present invention is not limited to a negative-charging toner.

In addition, the developer storage chamber 20B is provided with a developer transport member 21 for transporting the toner 9 to the developing chamber 20A, and the developer transport member 21 transports the toner 9 to the developing chamber 20A by rotating in a direction of an illustrated arrow G.

The developing chamber 20A is provided with the developing roller 4 as a developer bearing member which comes into contact with the photosensitive drum 1 and which rotates in a direction of an illustrated arrow D by receiving a driving force from a drive motor M200 as development driving means. In the present embodiment, the developing roller 4 and the photosensitive drum 1 respectively rotate so that surfaces thereof move in a same direction at an opposing portion (a contact portion). In addition, a bias sufficient to develop and visualize an electrostatic latent image on the photosensitive drum 1 as a toner image is applied to the developing roller 4 from a developing bias power supply (a high-voltage power supply) as developing bias applying means (not illustrated).

Furthermore, a toner supplying roller (hereinafter, simply referred to as a "supplying roller") 5 which supplies the toner transported from the developer storage chamber 20B to the developing roller 4 and a toner amount restricting member (hereinafter, simply referred to as a "restricting member") 8 which restricts a coating amount and provides a charge to the toner on the developing roller 4 having been supplied by the supplying roller 5 are arranged inside the developing chamber 20A.

In addition, the developing cartridge 200 is provided with a nonvolatile memory (hereinafter, referred to as a "DT memory") M2 as a second memory. The DT memory M2 stores the number of revolutions, a remaining toner amount, and the like of the developing roller 4 and, based on the information stored in the DT memory M2, a use amount of the developing cartridge can be assessed. The DT memory M2 is configured so as to be capable of communicating (writing and reading information) with the control portion 101 of the image forming apparatus 100 in a contactless manner or by contact via an electrical contact.

Block Diagram

Figure 6:
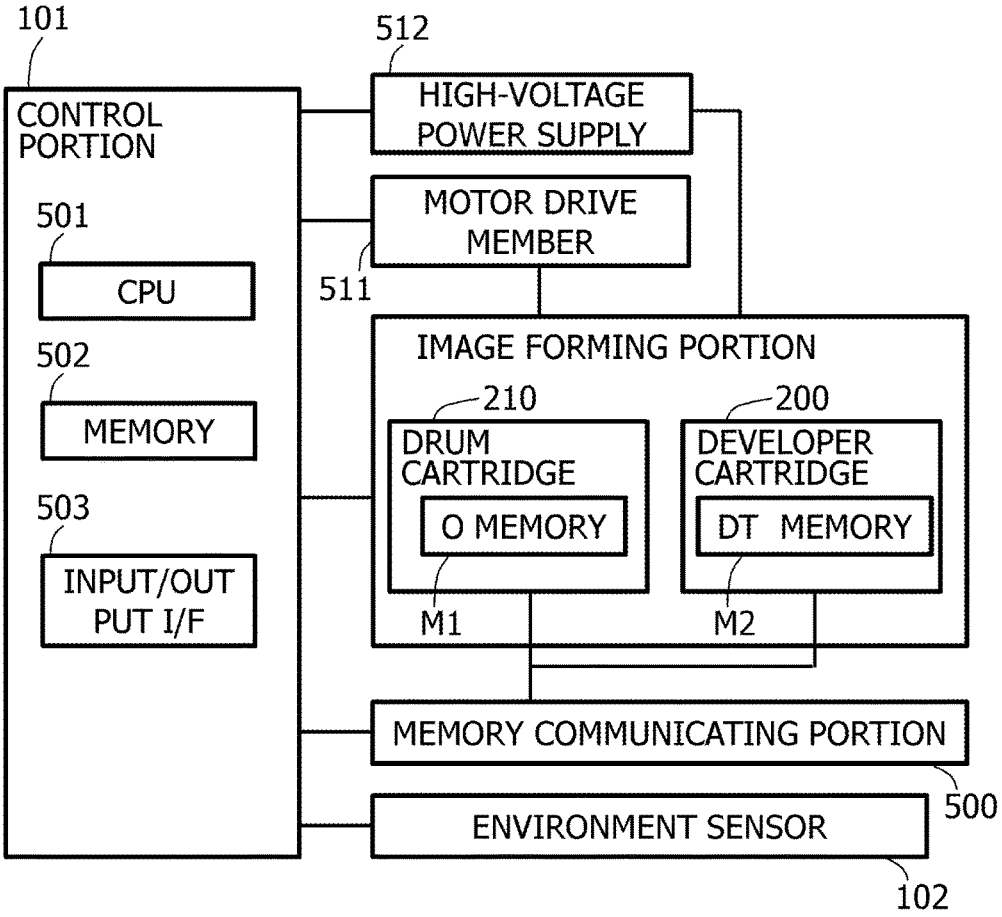
FIG. 6 is a control block diagram of the first embodiment.

Next, a control block diagram of the image forming apparatus 100 will be described with reference to FIG. 6.

The control portion 101 has a CPU (a central processing unit) 501 which is a core element for performing arithmetic processing, a memory 502 which is storing means such as a ROM and a RAM, an input/output interface which performs input and output of information to and from peripheral devices, and the like. The RAM stores a detection result of a sensor, a calculation result, and the like, and the ROM stores a control program, data tables obtained in advance, and the like. The control portion 101 is a control device that comprehensively controls operations of the image forming apparatus 100, and each control object in the image forming apparatus 100 is connected to the control portion 101 via the input/output IF. The control portion 101 also controls transmission and reception of various electrical information signals, drive timings, and the like and manages processing of the flow charts and the like to be described later.

A motor drive member 511 refers to various motors which are power sources for rotationally driving a polygon scanner, the photosensitive drum 1, the developing roller 4, and the like and operates based on a control signal from the control portion 101. A high-voltage power supply 512 is a power supply that applies high voltage to the photosensitive drum 1, the charging roller 2, the developing roller 4, the primary transfer roller 32, the secondary transfer roller 33, the fixing apparatus 34, and the like.

In addition, data communication is performed between the control portion 101, and the O memory M1 and the DT memory M2, via a memory communicating portion 500. Furthermore, an environmental sensor 102 such as a temperature sensor is connected to the control portion 101.

Toner Ejection Operation

Next, a toner supply operation (hereinafter, referred to as a "toner ejection operation") according to the present first embodiment will be described.

The toner ejection operation is an operation performed during a period in which image formation is not performed for supplying toner to the surface of the photosensitive drum 1 from the developing cartridge 200 and supplying the toner 9 between the cleaning blade 6 as a contact member and the surface of the photosensitive drum 1. A sequence of the toner ejection operation is executed by the control portion 101.

The toner ejection operation in the present embodiment is performed in order to maintain lubricity between the cleaning blade 6 and the photosensitive drum 1 during an operation (hereinafter, referred to as a "post-rotation operation") after image formation among the periods in which image formation is not performed. The post-rotation operation refers to an operation for driving the photosensitive drum 1 for a while even after a last print of a print job is finished in order to execute an image formation ending process. The post-rotation operation is an operation performed by the image forming apparatus 100 after all image formation and output of a job involving forming and outputting images to one or a plurality of recording materials 12 has ended.

In this case, in addition to during the post-rotation operation (a post-rotation step), "periods in which image formation is not performed" include during a pre-rotation step that is a preparatory operation period prior to image formation and during standby when a print instruction is not being input from an external apparatus. In essence, "periods in which image formation is not performed" are periods other than a period in which an image forming process including charging, exposure, development, and transfer is being executed with respect to information (image data) to be recorded which is input from the outside.

In the toner ejection operation, exposure corresponding to printing a solid image is performed by the scanner unit 30 and a band-like ejection pattern is formed by toner on the photosensitive drum 1 in a similar state to during image formation. In this case, a similar state to during image formation refers to a state where the photosensitive drum 1 and the developing roller 4 are rotationally driven, the photosensitive drum 1 is uniformly charged, and a developing bias is applied to the developing roller 4.

As will be described later, by changing a primary transfer bias applied to the primary transfer roller 32 in accordance with a print status, the control portion 101 performs control so that the ejection pattern of toner formed on the photosensitive drum 1 is recovered by the cleaning blade 6. In the present embodiment, the control portion 101 performs control so as not to apply the primary transfer bias. Accordingly, the ejection pattern of toner on the photosensitive drum 1 is prevented from being transferred to the intermediate transfer belt 31 and a toner amount that is recovered by the cleaning blade 6 can be increased. Alternatively, due to control by the control portion 101, when the toner ejection pattern passes through a transfer nip portion of the primary transfer roller 32, a primary transfer bias with reverse polarity to during normal image formation may be applied to the primary transfer roller 32.

Since the toner recovered by the cleaning blade 6 due to the toner ejection operation ends up being stored inside the drum cartridge frame body 11, the toner is not used for image formation. In addition, when a toner amount supplied to the cleaning blade 6 due to the toner ejection operation is excessive, a cleaning capability of the cleaning blade 6 is exceeded and faulty cleaning occurs in which the toner bypasses the cleaning blade 6 to a downstream side in a rotation direction of the photosensitive drum 1. When faulty cleaning occurs, a surface of the charging roller 2 is stained by the bypassed toner.

Therefore, the toner amount used in the toner ejection operation is desirably reduced as much as possible while still enabling lubricity between the cleaning blade 6 and the photosensitive drum 1 to be maintained.

Relationship Between Agglomeration Degree of Toner and Ejected Toner Amount

Figure 4:
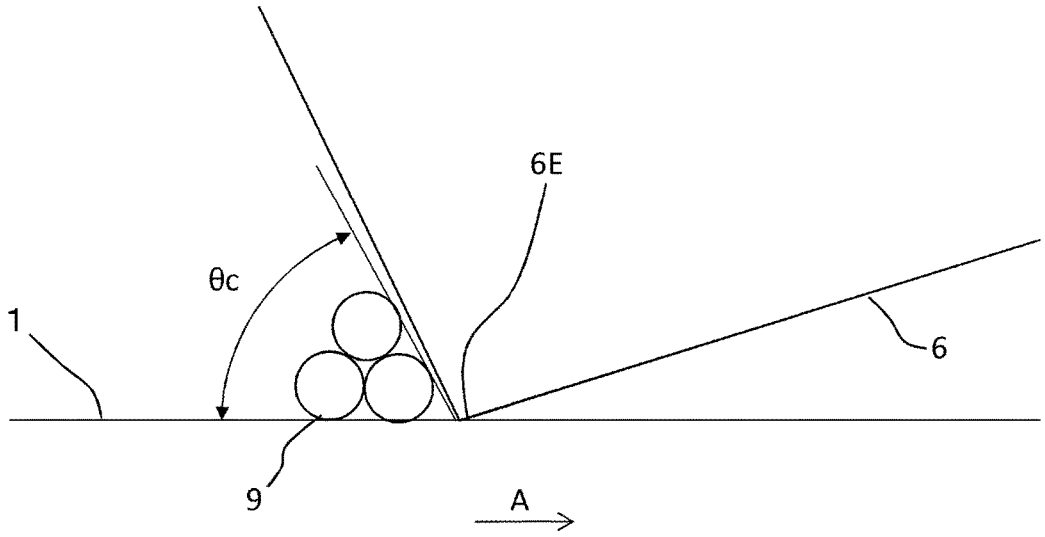
FIG. 4 is a schematic view of a vicinity of an edge portion of a cleaning blade illustrated in FIG. 1.

A relationship between a cohesion degree of toner and an ejected toner amount will now be described with reference to FIG. 4. FIG. 4 is a diagram schematically illustrating a situation near an edge portion 6E (a contact region) of the cleaning blade 6.

The cohesion degree of toner is a value measured by a method described below and represents the fact that the lower the cohesion degree, the smaller a binding force between particles of the toner and the more likely the toner is to behave as single particles.

As a measuring apparatus, a powder tester (manufactured by HOSOKAWA MICRON CORPORATION) having a digital vibration meter (DIGITAL VIBRATION METER MODEL 1332, manufactured by Showa Sokki Corporation) is used. As a measurement method, 390 mesh, 200 mesh, and 100 mesh sieves are stacked and set on a shaking table in an ascending order of mesh sizes or, in other words, in an order of sieves of 390 mesh, 200 mesh, and 100 mesh so that the 100 mesh sieve is stacked at the top. 5 g of an accurately weighed sample (toner) is placed on the set 100 mesh sieve, a value of displacement of the digital vibration meter is adjusted to 0.60 mm (peak-to-peak), and vibration is applied for 15 seconds. Subsequently, a mass of the sample remaining on each sieve is measured and a cohesion degree is obtained based on the following equation. The measured samples are left out in a 23° C., 60% RH environment for 24 hours in advance, and the measurement is also performed in a 23° C., 60% RH environment.

Agglomeration degree (%)=(residual sample mass on 100 mesh sieve/5 g)×100+(residual sample mass on 200 mesh sieve/5 g)×60+(residual sample mass on 390 mesh sieve/5 g)×20

When the cohesion degree of toner is low, the toner 9 more readily reaches a contact region between the cleaning blade 6 and the photosensitive drum 1. On the other hand, when the cohesion degree of toner is high, the toner is removed from the surface of the photosensitive drum 1 before reaching the edge portion 6E of the cleaning blade 6 and is more likely to be recovered inside the drum cartridge frame body 11. In other words, when the cohesion degree of toner is high, a toner ejection operation with a larger toner amount is performed in order to maintain the lubricity between the cleaning blade 6 and the surface of the photosensitive drum 1.

For example, the cohesion degree of toner is low and the toner more readily reaches the contact region between the cleaning blade 6 and the photosensitive drum 1 immediately after the start of use of the developing cartridge 200. On the other hand, when the developing cartridge 200 has been continuously used (when a use amount of the developing cartridge 200 has increased), the cohesion degree of toner increases and the toner is less likely to reach the contact region between the cleaning blade 6 and the photosensitive drum 1. Since the cohesion degree of toner also varies due to a type of the toner, a main body use environment, and the like, a toner amount to be supplied to the cleaning blade 6 in the toner ejection operation is controlled accordingly.

Relationship Between Cleaning Angle θc and Ejected Toner Amount

Next, a relationship between a cleaning angle θc and an ejected toner amount will be described with reference to FIG. 4. As illustrated in FIG. 4, the cleaning angle θc refers to an angle formed between the surface of the photosensitive drum 1 and the cleaning blade 6. The cleaning angle θc changes depending on a type of the cleaning blade 6 and contact pressure of the cleaning blade 6 with respect to the photosensitive drum 1 and, as will be described below, a preferable ejected toner amount for maintaining the lubricity between the cleaning blade 6 and the photosensitive drum 1 changes depending on the cleaning angle θc.

A small cleaning angle θc represents a narrow gap between the cleaning blade 6 and the surface of the photosensitive drum 1, in which case the toner 9 is less likely to reach the edge portion 6E of the cleaning blade 6 and the toner 9 is more likely to bypass the cleaning blade 6 to a downstream side in the drum rotation direction. On the other hand, a large cleaning angle θc represents a wide gap between the cleaning blade 6 and the surface of the photosensitive drum 1, in which case the toner 9 more readily reaches the edge portion 6E of the cleaning blade 6 and is more likely to remain near the edge portion 6E of the cleaning blade 6. In other words, a toner amount for maintaining lubricity varies depending on the cleaning angle θc and, when the cleaning angle θc is small, the toner amount to be supplied to the cleaning blade 6 is increased.

For example, the cleaning angle θc varies depending on a hardness of the rubber blade 6A, contact pressure between the rubber blade 6A and the photosensitive drum 1, a use environment of the image forming apparatus main body, and the like. The cleaning angle θc also varies depending on a use state of the drum cartridge 210, and when a use amount of the drum cartridge increases, settling of the rubber blade 6A occurs and the cleaning angle θc decreases.

In order to maintain the lubricity between the cleaning blade 6 and the photosensitive drum 1 while suppressing the toner amount used in the toner ejection operation under such various conditions, the ejected toner amount when performing a toner ejection operation is controlled.

To this end, in the present invention, the O memory M1 has a first calculation table TX storing ejection information as information related to an ejected toner amount during toner supply in accordance with a use amount of the drum cartridge 210 (a drive amount of the photosensitive drum 1) as illustrated in FIG. 5A. In the illustrated example, appropriate toner ejection information X is set in accordance with a drum cartridge use amount and a main body use environment detected by the environmental sensor 102 as an environment detector and stored in the first calculation table TX. In the present embodiment, as an example, the number of main scanning lines is defined by the ejection information X. In addition, a length in a sub-scanning direction is defined by the number of main laser scanning lines. As a drive amount of the photosensitive drum 1, a proportion of a period of use relative to replacement life is displayed as a percentage. The drive amount of the photosensitive drum 1 may be an amount that directly represents driving of the photosensitive drum 1 such as the number of revolutions or a rotation time of the photosensitive drum 1 or an amount that indirectly represents driving of the photosensitive drum I such as the number of printed sheets or an energization time of a motor that drives the photosensitive drum 1. In addition, the drive amount of the photosensitive drum 1 also includes parameters based on a remaining life such as a remaining number of possible revolutions or a remaining rotation time which decreases with driving of the photosensitive drum 1.

The O memory M1 stores information related to operation amounts such as the number of revolutions of the photosensitive drum 1. The O memory M1 also stores information that enables a type of the drum cartridge 210 to be specified such as a serial number and a model. In addition, based on the information in the O memory M1, the control portion 101 is capable of assessing amounts related to use of the drum cartridge in terms of how much the drum cartridge has been used and how long the drum cartridge has been operational. Regarding a transition in the ejected amount in FIG. 5A, at the start of use of the drum cartridge 210 (0% to 24%), since toner as a lubricant has not been sufficiently supplied to the cleaning blade 6, the ejected amount is increased. Subsequently (25% to 74%), there is no increase since supply has ended, but in a latter half (75% to 100%), since the toner's function as a lubricant declines due to deterioration of the toner, the ejected amount is increased once again.

On the other hand, the DT memory M2 has a second calculation table TY storing ejection information Y that is information related to a toner amount during toner supply in accordance with a use amount of the developing cartridge 200 as illustrated in FIG. 5B. Even in this case, an appropriate ejected toner amount Y is set in accordance with a use amount of the developing cartridge 200 and the main body use environment detected by the environmental sensor 102 as an environment detector and stored in the second calculation table TY.

A use amount of the developing cartridge 200 is determined by an accumulated number of revolutions of the developing roller 4 and a remaining toner amount (an accumulated use amount). The control portion 101 of the image forming apparatus main body has, in the memory 502 in advance, a table to which is input a combination of the accumulated number of revolutions of the developing roller 4 and a remaining toner amount corresponding to the toner use amount and which outputs a use rate of the developing cartridge 200.

The ejected toner amount is configured to be changeable depending on information on the temperature detected by the environmental sensor 102 because the cohesion degree of toner and the hardness of the cleaning blade 6 are affected by the main body use environment. Correspondence to temperature information enables the ejected toner amount to be controlled with higher accuracy.

When performing toner ejection control (toner supply), the control portion 101 controls the ejected toner amount based on the ejection information X stored in the O memory M1 and the ejection information Y that is information stored in the DT memory M2. In the present embodiment, an ejected toner amount (X+Y) that is a toner supply amount is calculated by adding up (calculating) the ejection information X stored in the O memory M1 and the ejection information Y stored in the DT memory M2.

In addition, in the present embodiment, the ejected toner amount is controlled by changing a length in a rotation direction of the photosensitive drum 1 (a sub-scanning direction).

The values of the calculation table of ejected toner amounts illustrated in FIG. 5A are simply an example, and by setting preferable values in accordance with a type of the cleaning blade 6 built into the drum cartridge 210, a type of the toner that fills the developing cartridge 200, and the like, a toner ejection operation can be executed with a preferable toner amount in various cartridge configurations.

For example, as illustrated in FIG. 5C, the ejection information X in the first calculation table may be given a negative value. Giving the ejection information X a negative value enables the ejected toner amount to be reduced by a combination of the drum cartridge 210 and the developing cartridge 200 even when only a small toner amount accumulates on the edge portion 6E of the cleaning blade due to an improvement of the toner 9, the cleaning blade 6, or the like.

In FIG. 5C, since toner is only supplied in an initial stage (0 to 24%) and supply of toner is unnecessary during (25% to 49%), (50% to 74%), and (75% to 100%), "−30" is entered. Accordingly, since X+Y takes a negative value, toner is not supplied. "−30" is merely an example and any value may be used as long as a sum of the value and the ejection information Y is a negative value.

Operation Sequence During Toner Ejection Operation

Figure 7:
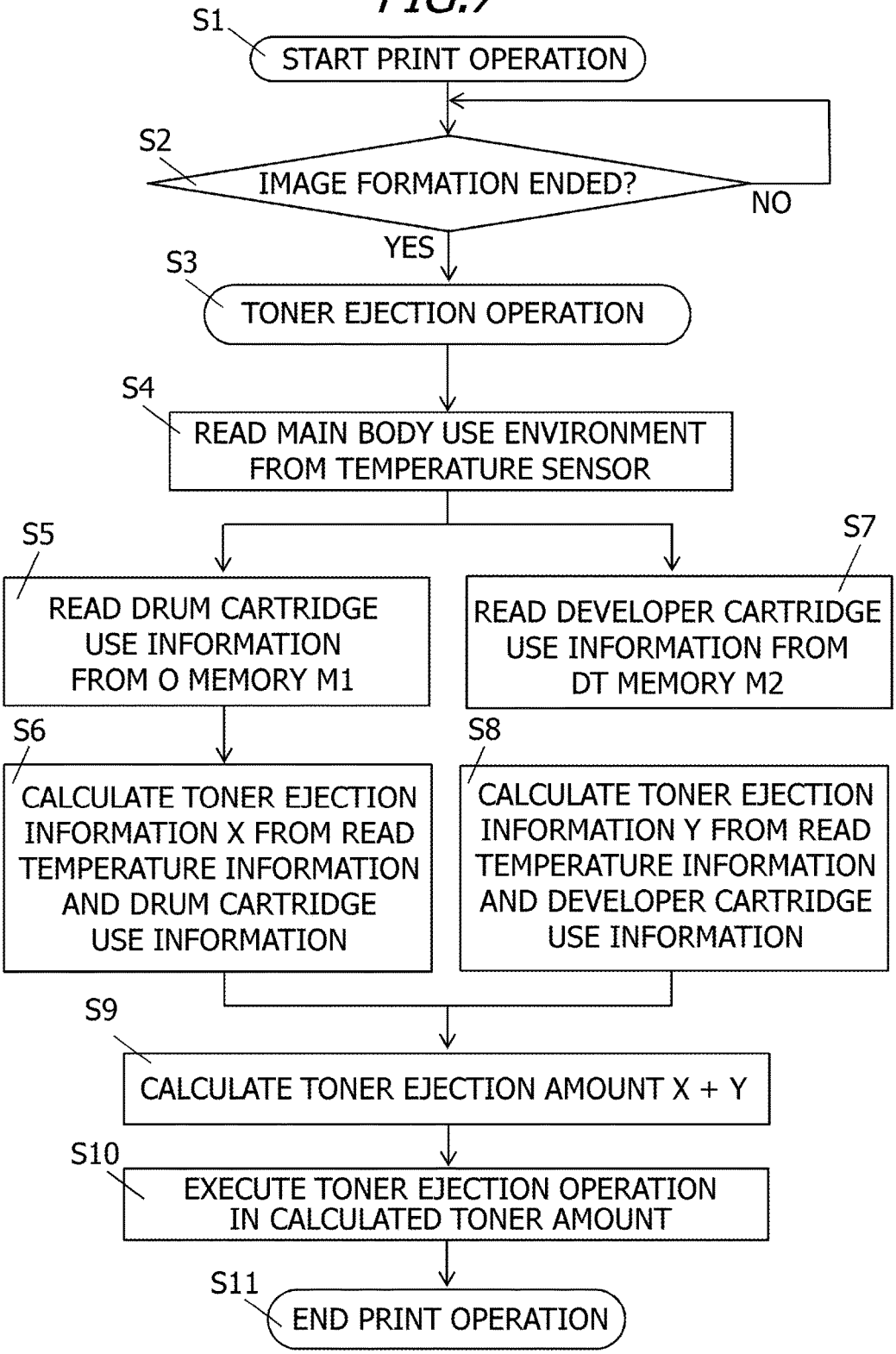
FIG. 7 is a sequence chart of a toner ejection operation according to the first embodiment.

Next, a sequence in a case where a toner ejection operation is performed in the image forming apparatus according to the first embodiment of the present invention will be described with reference to FIG. 7.

For example, when image information is input from a host device (not illustrated) connected to the image forming apparatus 100, in the control portion 101, the CPU 501 reads a sequence of a print job stored in the memory 502 and starts a print operation (S1), and when the control portion 101 determines that image formation has ended (S2), the control portion 101 executes a post-rotation operation and, at the same time, reads a sequence for toner ejection stored in the memory 502 and starts a toner ejection operation (S3). When the toner ejection operation is started, the control portion 101 reads temperature information by communicating with the environmental sensor 102 provided in the image forming apparatus main body (S4). Next, the control portion 101 communicates with the O memory M1 mounted to the drum cartridge 210 through a data bus of a memory communicating portion 500 and reads a drum cartridge use amount (S5). Subsequently, based on the read temperature information and the drum cartridge use amount, the control portion 101 calculates the ejection information X stored in the first calculation table TX in the O memory M1 (S6).

On the other hand, the control portion 101 communicates with the DT memory M2 mounted to the developing cartridge 200 to read a developing cartridge use amount (S7). Subsequently, based on the read temperature information, the developing cartridge use amount, and information in the second calculation table TY stored in the DT memory M2, the control portion 101 calculates ejection information Y (S8).

In addition, the control portion 101 adds up the calculated ejection information X and the ejection information Y and calculates a final ejected toner amount X+Y (S9) and, based on the calculated ejected toner amount X+Y, executes a toner ejection operation with respect to the cleaning blade 6 (S10). The photosensitive drum 1 is rotated for a prescribed time after toner ejection to the surface of the photosensitive drum 1 is performed and the print job is ended (S11).

Performing the control described above enables stable cleaning performance to be maintained with a small toner amount in various cartridge configurations.

Experiment

Next, the following verification experiment was performed in order to verify the effects described above.

A 2-print intermittent printing durability test was performed in an environment under low temperature, low humidity conditions (temperature 15° C., humidity 10%). In the printing durability test, a horizontal line with an image ratio of 1% was printed every three prints. The printing durability test was performed until the use amounts of the developing cartridge 200 and the drum cartridge 210 reached 100%, and "good" was assessed when a cleaning blade squeal (abnormal noise) did not occur but "bad" was assessed when the cleaning blade squeal occurred.

In addition, a halftone image was printed after the printing durability test ended, and "good" was assessed when streaks or image density non-uniformity attributable to staining of the charging roller 2 did not occur but "bad" was assessed when streaks or image density non-uniformity occurred.

Furthermore, the present experiment was performed using various combinations of two types of toners, namely, a toner A and a toner B, and two types of cleaning blades, namely, a cleaning blade C and a cleaning blade D.

The toners used in the experiment were toners with different cohesion degrees as characteristics in an initial state. A toner with characteristics including a cohesion degree of 15% was used as the toner A and a toner with characteristics including a cohesion degree of 35% was used as the toner B. As the cleaning blades used in the experiment, a cleaning blade with characteristics including a hardness of 65° was used as the cleaning blade C and a cleaning blade with characteristics including a hardness of 80° was used as the cleaning blade D as measured by an MD-1 hardness tester.

In addition, as the first calculation table of the ejected toner amount X stored in the O memory M1, a table Xc optimized for the cleaning blade C and a table Xd optimized for the cleaning blade D were used. Furthermore, as the second calculation table TY of the ejected toner amount Y stored in the DT memory M2, a table Ya optimized for the toner A and a table Yb optimized for the toner B were used.

Configurations used to perform the experiment are described in Table 1.

TABLE 1

| | Experiment configuration | | Toner ejection | Toner |
|---|---|---|---|---|
| | Toner | Cleaning blade | amount X calculation table | ejection amount Y calculation table |
| Practical example 1 | A | C | Table Xc | Table Ya |
| Practical example 2 | B | C | Table Xc | Table Yb |
| Practical example 3 | A | D | Table Xd | Table Ya |
| Comparative example 1 | B | C | Table Xc | Table Ya |
| Comparative example 2 | A | D | Table Xc | Table Ya |

Practical examples 1 to 3 represent cases where values of the first calculation table TX of the ejection information X stored in the O memory M1 and the second calculation table TY of the ejection information Y stored in the DT memory M2 are optimized in accordance with combinations of the toner and the cleaning blade.

Meanwhile, comparative examples 1 and 2 represent cases where values of the first calculation table TX of the ejection information X stored in the O memory M1 and the second calculation table TY of the ejected toner amount Y stored in the DT memory M2 are not optimized and the tables Xc and Ya are used. In other words, the comparative example 1 is an example in which the table Ya is used despite the table Yb being an optimized table and the comparative example 2 is an example in which the table Xc is used despite the table Xd being an optimized table.

Results thereof are presented in Table 2.

TABLE 2

| | Blade squeal | Charging roller staining |
|---|---|---|
| Practical example 1 | Good | Good |
| Practical example 2 | Good | Good |
| Practical example 3 | Good | Good |
| Comparative example 1 | Bad | Good |
| Comparative example 2 | Good | Bad |

In the case of the comparative example 1, due to the use of the table Ya having been optimized for the toner A with a low cohesion degree with respect to the toner B with a high cohesion degree, the ejected toner amount is insufficient to maintain a low friction force between the cleaning blade and the surface of the photosensitive drum and a cleaning blade squeal occurred.

In the case of the comparative example 2, due to the use of the table Xc having been optimized for the cleaning blade C with a low hardness with respect to the cleaning blade D with a high hardness, an excessive amount of toner ejection is performed at the contact region between the cleaning blade and the photosensitive drum and faulty cleaning occurred.

On the other hand, with the practical examples 1 to 3, due to the use of calculation tables of the ejected toner amount X and the calculation tables of the ejected toner amount Y which had been optimized in accordance with the types of toners and the types of cleaning blades, an ejected toner amount to the cleaning blade 6 is optimized. Accordingly, staining of the charging roller attributable to a cleaning blade squeal or faulty cleaning is prevented.

While control involving storing the first calculation table TX of the ejection information X in the O memory M1 and the second calculation table TY of the ejection information Y in the DT memory M2 and adding by the control portion 101 is performed in the present first embodiment as illustrated in FIGS. 5A and 5B, control is not limited thereto.

For example, control involving weighting any of values of the ejection information X and values of the ejection information Y and determining a final ejected toner amount may be performed. Weighting enables a variation width of the ejected toner amount to be increased even when a storage area for storing the first calculation table of the ejected toner amount X and the second calculation table of the ejected toner amount Y is small.

To give a description with reference to FIGS. 5B and 5D, with respect to the ejection information Y of the second calculation table TY in FIG. 5B, a multiplying factor at which the values of the ejection information Y of the second calculation table TY are weighted is stored as ejection information X of the first calculation table TX as illustrated in FIG. 5D. The control portion 101 calculates an ejected toner amount by multiplying the ejection information Y stored in the second calculation table TY by the multiplying factor (a coefficient).

In this case, since there are a plurality of pieces of the ejection information Y in the second calculation table TY in accordance with use amounts of the developing cartridge 200, for example, in FIG. 5A, a case of a drum use amount (0% to 24%) of the first calculation table TX in a use environment of (15° C. or lower) may be described as follows. Specifically, in accordance with the use amounts (0% to 24%), (25% to 49%), (50% to 74%), and (75% to 100%) of the developing cartridge 200, respectively corresponding multiplying factors (×4), (×2), (×2), and (×1.6) are set. When the use amount of the developing cartridge is (50% to 74%), an ejected toner amount of 6×2=12 [lines] is obtained. Other pieces of data may also be described in a similar manner. In addition, in order to reduce capacities used for calculation tables of the ejected toner amount with respect to total capacities of the O memory M1 and the DT memory M2, values for calculating the ejected toner amount may be stored in a storage portion of the main body.

For example, a method can be used in which a constant value of the ejected toner amount is stored in advance in the memory 502 of the control portion 101 of the image forming apparatus and a value by which the value in the memory 502 is to be multiplied is stored in the first calculation table TX of the ejection information X and the second calculation table TY of the ejection information Y. FIG. 5E represents an example of the first calculation table TX. In this case, for example, when "2" is stored in the memory 502 of the control portion 101 of the main body, values to be multiplied are entered such as (×3), (×0), (×0), and (×1). The second calculation table can be described in a similar manner and a specific description thereof will be omitted.

Alternatively, address values may be stored in the first calculation table of the ejected toner amount X and the second calculation table of the ejected toner amount Y and correspondence tables that enable ejected toner amounts to be specified with respect to the respective address values may be stored in the memory 502 of the control portion 101 of the main body.

Specifically, a first address value as information related to a toner amount during toner supply in accordance with a drive amount of the photosensitive drum 1 is stored in the first calculation table, and a second address value as information related to a toner amount during toner supply in accordance with a use amount of the developing cartridge 200 is stored in the second calculation table. On the hand, tables that enable ejected toner amounts to be specified with respect to the first address value and the second address value are stored in the memory 502 provided in the control portion 101.

One of the tables that enable ejected toner amounts to be specified with respect to address values stored in the memory 502 of the control portion 101 may be given negative values in a similar manner to FIG. 5C. Giving the ejection information X a negative value enables the ejected toner amount to be reduced by a combination of the drum cartridge 210 and the developing cartridge 200 even when only a small toner amount accumulates on the edge portion 6E of the cleaning blade 6 due to an improvement of the toner 9, the cleaning blade 6, or the like.

Second Embodiment

The present second embodiment represents an example in which, in addition to the toner ejection operation described in the first embodiment, an ejection count is stored in the memory 502 of the control portion 101 which is a main body storage portion and a toner ejection sequence (a regular supply mode) is performed when the ejection count reaches a prescribed value. A program of the sequence in the regular supply mode is stored in the control portion 101. The toner ejection operation described in the first embodiment will be called a "pre-separation ejection operation" or a "simple ejection operation" and the toner ejection operation performed when the ejection count reaches a prescribed value or more will be called a "count ejection operation". "Pre-separation" means that the "ejection operation" according to the first embodiment is performed in a state where the intermediate transfer belt is in contact with the photosensitive drum 1 (a pre-separation state) and, in the present second embodiment, the "ejection operation" is performed in a state where the intermediate transfer belt 31 is separated from the photosensitive drum 1. In addition, "simple" means that a formed ejection pattern is defined by several main laser scanning lines as described using the tables in FIGS. 5A to 5D and is a simpler pattern than the count ejection operation (to be described later). Furthermore, as the ejection count, the number of "pre-separation ejection operations" may be counted or the number of printed prints or the number of printed sheets may be counted. Alternatively, the ejection count may be an amount that indirectly represents an ejection count such as the number of revolutions or a rotation time of the photosensitive drum 1 or an energization time of a motor that drives the photosensitive drum 1.

According to the present second embodiment, by setting a larger toner amount to be supplied to the cleaning blade 6 in the count ejection operation than a toner amount used in the pre-separation ejection operation, the time consumed by the pre-separation toner ejection operation can be reduced.

Specifically, when the pre-separation ejection operation is considered a first toner supply, the control portion 101 sets a toner supply amount by the count ejection operation in the regular supply mode which is larger than a first toner supply amount by the first toner supply as a second toner supply amount. The control portion 101 has counting means (for example, an encoder provided in a rotating portion or a counter provided in the control portion 101) which performs the count described above for the second toner supply and the memory 502 which stores a counted value by the counting means, and executes toner supply in the second toner supply amount between the cleaning blade (the contact member) and the surface of the photosensitive drum 1 when the count reaches a prescribed value.

In other words, the numbers of revolutions of the photosensitive drum 1 and the developing roller 4 are prevented from increasing and unnecessary shortening of the lives of the photosensitive drum 1 and the developing roller 4 due to toner ejection operations can be suppressed.

Operation Sequence During Count Ejection Operation

Figure 8:
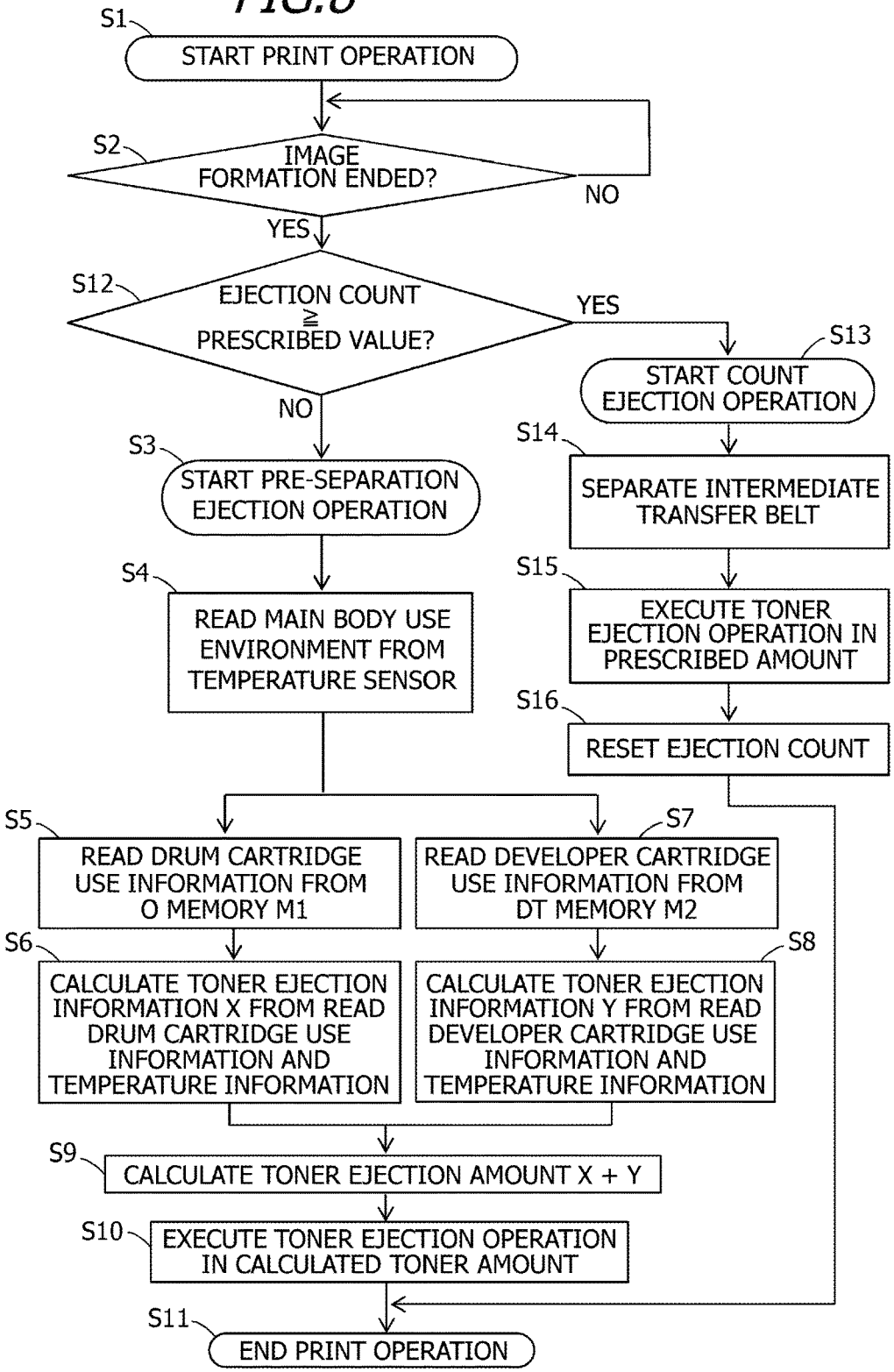
FIG. 8 is a sequence chart of a toner ejection operation according to a second embodiment.

Hereinafter, a sequence (the regular supply mode) in a case where a toner ejection operation is performed according to the present second embodiment will be described with reference to FIG. 8. In the following description, same steps as in the first embodiment will be denoted by same reference characters and a description thereof will be omitted.

When image information is input from a host device connected to the image forming apparatus main body, in the control portion 101, the CPU 501 reads a sequence of a print job stored in the memory 502 and starts a print operation (S1). In addition, when the print operation by the image forming apparatus main body ends and the control portion 101 determines that image formation has ended (YES in S2), the control portion 101 determines whether or not the ejection count is equal to or larger than a prescribed value (S12). When the control portion 101 determines that the ejection count is smaller than the prescribed value, a toner ejection operation is started in a post-rotation operation as described in the first embodiment (S3). Since details of the pre-separation ejection operation in steps S4 to S10 have already been described in the first embodiment, descriptions thereof will be omitted here.

On the other hand, when the control portion 101 determines that the ejection count is equal to or larger than the prescribed value, the control portion 101 starts a sequence (the regular supply mode) of a count ejection operation (S13). When the count ejection operation is started, the intermediate transfer belt 31 is separated from the photosensitive drum 1 under an instruction from the control portion 101 (S14). Subsequently, toner ejection from the developing roller 4 to the photosensitive drum 1 is performed (S15). In the present embodiment, the prescribed value of the ejection count is set to 500 prints, and a solid black toner image with a length corresponding to a circumferential length of one circumference of the developing roller 4 is formed on the surface of the photosensitive drum 1 in a direction perpendicular to a longitudinal direction of the developing roller 4 and fed to the cleaning blade 6. In this case, a solid black toner image refers to a toner image with a density of 100%.

After the count ejection operation ends, the control portion 101 resets the ejection count (S16) and ends the print operation (S11).

While it is described that the control portion 101 performs the determination of step S12 immediately before step S3 in the description given above, this prescribed order is not restrictive. For example, a similar effect to the above can be produced even when the control portion 101 performs the process of step S12 immediately after the process of step S10.

In this manner, by setting a larger ejected toner amount in the count toner ejection operation than an ejected toner amount in the pre-separation toner ejection operation, the pre-separation toner ejection operation can be shortened. Accordingly, the effect of the pre-separation toner ejection operation on the lives of the photosensitive drum 1 and the developing roller 4 can be reduced.

While the regular toner ejection operation is performed during post-rotation in the present embodiment, this configuration is not restrictive. A count ejection operation may be independently performed after printing ends.

According to the present invention, an image forming apparatus capable of controlling a toner amount to be fed to a contact member to a preferable amount can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-010094, filed on Jan. 24, 2018 which is hereby incorporated by reference herein in its entirety.

What is claimed is:

1. An image forming apparatus comprising:

an image bearing member unit constituted by a rotatable image bearing member on which an electrostatic latent image is formed and a cleaning blade configured to come into contact with a surface of the image bearing member in a rotating state to remove toner from the surface of the image bearing member;

a developing unit configured to supply toner to the surface of the image bearing member to develop the electrostatic latent image as a toner image; and a control device configured to, during a period where image formation is not performed, supply toner to the surface of the image bearing member from the developing unit to perform toner supply between the cleaning blade and the surface of the image bearing member, wherein the image bearing member unit and the developing unit are respectively configured to be independently attachable to and detachable from an apparatus main body of the image forming apparatus, wherein the image bearing member unit has a first memory that stores information related to a toner amount during the toner supply in accordance with a use amount of the image bearing member unit, wherein the developing unit has a second memory that stores information related to a toner amount during the toner supply in accordance with a use amount of the developing unit, and wherein the control device controls, during the toner supply, the toner supply with a toner amount based on the information stored in the first memory and the information stored in the second memory.

2. The image forming apparatus according to claim 1, wherein the control device calculates a toner supply amount by performing a calculation based on the information stored in the first memory and the information stored in the second memory.

3. The image forming apparatus according to claim 1, wherein the use amount of the image bearing member unit is an amount that directly represents driving of the image bearing member.

4. The image forming apparatus according to claim 1, wherein the use amount of the image bearing member unit is an amount that indirectly represents driving of the image bearing member.

5. The image forming apparatus according to claim 1, wherein the use amount of the developing unit is determined by a relationship between the number of revolutions of a developing roller provided in the developing unit and a toner use amount.

6. The image forming apparatus according to claim 1, further comprising an environment detector, wherein the control device controls the toner supply based on a detection result of the environment detector, the information stored in the first memory, and the information stored in the second memory.

7. The image forming apparatus according to claim 1, wherein the information related to the toner amount during the toner supply in accordance with the use amount of the image bearing member unit is determined in accordance with characteristics of the cleaning blade used in the image bearing member unit.

8. The image forming apparatus according to claim 1, wherein the information related to the toner amount during the toner supply in accordance with the use amount of the developing unit is determined in accordance with characteristics of a toner used in the developing unit.

9. The image forming apparatus according to claim 1, wherein the toner supply between the cleaning blade and the surface of the image bearing member is performed during a rotation step, after completion of a job including formation of images on one or a plurality of recording materials, within a period in which image formation is not performed.

10. The image forming apparatus according to claim 1, wherein the first memory has a first calculation table storing the information related to the toner amount during the toner supply in accordance with the use amount of the image bearing member unit, and the second memory has a second calculation table storing the information related to the toner amount during the toner supply in accordance with the use amount of the developing unit.

11. The image forming apparatus according to claim 10, wherein the first calculation table stores a multiplying factor at which weighting has been performed on a value of the information related to the toner amount stored in the second calculation table, and the control device calculates a toner amount by multiplying the information related to the toner amount stored in the first calculation table by the multiplying factor.

12. The image forming apparatus according to claim 10, wherein, during the toner supply, the control device refers to the first calculation table and calculates a first toner supply amount to be supplied based on the information related to the toner amount in accordance with the use amount of the image bearing member unit, refers to the second calculation table and calculates a second toner supply amount based on the information related to the toner amount in accordance with the use amount of the developing unit, and controls the toner supply by adding up the first toner supply amount and the second toner supply amount.

13. The image forming apparatus according to claim 12, wherein at least one of the first calculation table and the second calculation table stores a negative value.

14. The image forming apparatus according to claim 10, wherein a memory provided in the control device stores a prescribed value of the toner supply amount, the first calculation table stores a value by which the prescribed value of the toner supply amount is to be multiplied, as the information related to the toner amount in accordance with the use amount of the image bearing member unit, and the second calculation table stores a value by which the prescribed value of the toner supply amount is to be multiplied, as the information related to the toner amount in accordance with the use amount of the developing unit.

15. The image forming apparatus according to claim 10, wherein the first calculation table stores a first address value as the information related to the toner amount during the toner supply in accordance with the use amount of the image bearing member unit, the second calculation table stores a second address value as the information related to the toner amount during the toner supply in accordance with the use amount of the developing unit, and a memory provided in the control device has a table on which the toner amount to be supplied is specified with respect to the first address value and the second address value.

16. The image forming apparatus according to claim 1, wherein when the toner supply is a first toner supply, the control device has a counting portion which performs a count for toner supply in a second toner supply amount that is larger than a first toner supply amount of the first toner supply and a memory which stores a counted value by the counting portion, and the control device executes toner supply in the second toner supply amount between the cleaning blade and the surface of the image bearing member when the counted value reaches a prescribed value.

17. The image forming apparatus according to claim 16, further comprising an intermediate transfer member configured to transfer a toner image formed on the image bearing member of the image bearing member unit, wherein, in a regular supply mode, the control device executes toner supply in a state where the intermediate transfer member is separated from the image bearing member.

18. The image forming apparatus according to claim 17, wherein the control device executes toner supply in a state where the intermediate transfer member is in contact with the image bearing member, when controlling toner supply based on the information stored in the first memory and the information stored in the second memory.

* * * * *